US005956944A

United States Patent [19]

Dementhon et al.

[11] Patent Number: 5,956,944

[45] Date of Patent: Sep. 28, 1999

[54] PROCESS AND DEVICE FOR CONTROLLING A PARTICULATE FILTER

[75] Inventors: Jean-Baptiste Dementhon, Paris; Brigitte Martin, Rueil-Malmaison; Olivier Pajot, Triel sur Seine, all of France

[73] Assignee: Institut Francais du Petrole, Rueil-Malmaison, France

[21] Appl. No.: 08/928,437

[22] Filed: Sep. 12, 1997

[30] Foreign Application Priority Data

Sep. 13, 1996 [FR] France ..... 96 11292

[51] Int. Cl.[6] ..... F01N 3/02

[52] U.S. Cl. ..... 60/274; 60/288; 60/311

[58] Field of Search ..... 60/274, 277, 286, 60/288, 311; 55/DIG. 30, 312

[56] References Cited

U.S. PATENT DOCUMENTS

| | | | |
|---|---|---|---|
| 4,502,874 | 3/1985 | Levie et al. | 55/283 |
| 5,582,002 | 12/1996 | Pattas | 60/274 |
| 5,651,250 | 7/1997 | Kawamura | 60/311 X |
| 5,655,366 | 8/1997 | Kawamura | 60/311 X |

*Primary Examiner*—Tony M. Argenbright

*Attorney, Agent, or Firm*—Antonelli, Terry, Stout & Kraus. LLP

[57] ABSTRACT

The invention relates to a process for controlling a particulate filter in the exhaust of a Diesel engine using an after-treatment of the particulates while requiring a minimum amount of energy. The process according to the invention adapts the geometry of a filter placed in the exhaust gas flow according to predetermined strategies linked with the running of the engine, the process being such that it limits a mean back pressure of the engine which degrades engine efficiency.

43 Claims, 5 Drawing Sheets

5
INPUT DATA
- UPSTREAM PRESSURE
- TEMPERATURES
- MASS FLOW RATE
- SPEED
CALCULATION OF THE POSITION OF VALVE 1
CALCULATION OF THE POSITION OF VALVE 2
CALCULATION OF THE POSITION OF VALVE 3
V1 set
V1 measured
+
−
exhaust gas
31
32
33
3
4
1
2
11
6
12
6
13

PROCESS AND DEVICE FOR CONTROLLING A PARTICULATE FILTER

BACKGROUND OF THE INVENTION

Field of the Invention

The present invention relates to the after-treatment of gases emitted at the exhaust of Diesel vehicles.

BACKGROUND OF THE INVENTION

Particulate emission standards have recently come into force in Europe. These standards will become more stringent in the coming years. By that time, improvements linked with engines and fuels may be insufficient, even in the presence of an oxidation catalytic muffler.

Particulate filters are a well-known exhaust gas after-treatment technique. It is thus possible to obtain filtration efficiencies above 80%. Many filter technologies have been developed to date. Examples thereof are the ceramic monolith marketed by the Corning Company, or the cartridge with coiled ceramic fibers as described in patent application WO-95/27,843.

The technical difficulty encountered for developing an after-treatment technique is that the filter must be periodically regenerated by combustion of the soot deposits. This combustion sometimes occurs naturally when the temperature of the gases reaches by itself the level required to initiate oxidation of the particulate matter. However, average running conditions generally lead to temperatures that are too low to spontaneously initiate combustion of the particulates. This leads to clogging of the filter, which is harmful to the engine efficiency. It is then necessary to provide artificial regeneration of the filter.

Many techniques have been developed to that effect. They can be essentially mechanical, based on changes in the running of the engine:intake throttling, exhaust throttling, advanced injection lag or local energy supply in the exhaust gases or at the level of the filter (resistor, burner, microwave, . . . ). It is then necessary to control these various devices by means of an outer control driven by a computer. Most often, the criterion taken into account for regeneration initiation is the back pressure in the exhaust line.

In order to facilitate regeneration of particulate filters, a different approach of chemical nature consists in adding to the fuel an additive, for example an organometallic additive that is found in the soot deposit, which generally leads to a decrease in the ignition temperature and therefore to a regeneration frequency increase.

Examples of the products most commonly used as additives are copper, iron, cerium, sodium, . . . Studies show that, in the presence of such additives, partial regenerations can occur spontaneously for relatively low exhaust gas temperatures (~200° C.).

Besides, in well-known systems, problems linked with the back pressure and/or the energy consumed are often encountered.

In fact, accumulation of particulate matter in the filter sometimes leads to a great increase in the back pressure and thus to an engine efficiency decrease. Patent application WO-95/18,292 is cited by way of example.

Concerning energy consumption, most of the well-known systems have a global heating of the catalytic element. This leads to a high energy consumption that is controlled. Patent EP-B1-0,485,179 illustrates a system based on this principle.

Furthermore, the regeneration conditions can highly depend on the fouling condition of the filter. The well-known means do not allow on the fouling of the filter. The present invention advantageously allows adapting the filtration phase to all the operating conditions of the vehicle. It also overcomes the problems of the prior art mentioned above.

SUMMARY OF THE INVENTION

The present invention provides improved control of the mean back pressure of the exhaust and therefore limits degradation of the engine efficiency. Furthermore, the present invention allows to minimizing the energy supply required for regeneration of the filter.

According to one of its aspects, the present invention is a process for controlling a particulate filter placed in the exhaust of a Diesel engine providing an after-treatment of the particulates, requiring a minimum amount of energy.

According to the invention, the process adapts the geometry of the filter placed in the exhaust as a function of predetermined strategies linked with the running of the engine, the process being such that it allows limiting the mean back pressure and thus limiting degradation of the engine efficiency.

According to one of the embodiments of the invention, the process adapt the volume in which the exhaust gases are filtered to the volume flow rate of the gases that enter the filter.

According to another embodiment of the invention, the process creates soot concentration heterogeneities in various zones of the filtering means.

Without departing from the scope of the invention, the process can reserve certain zones of the filter for certain soot types.

More particularly, an array of partitions isolate the various zones forming the filter is used.

The partitions can be advantageously provided with openings so arranged that they allow propagation of the combustion from one zone to the other.

Furthermore, the process according to the invention allows, when fouling of the filter exceeds a predetermined threshold value, heating to occur of the gases that is required for regeneration. In other words, the process limits temporarily the section of flow of the exhaust gases in the filter when fouling exceeds a determined threshold value, in order to trigger regeneration through temperature rise of the gases.

The invention is also a device for controlling filtration and regeneration of a particulate filter comprising:

filter means divided in at least two filtering zones, a throttling device associated with at least one of the filtering zones which modulates distribution of the gas flow between the various filter zones.

More particularly, it further comprises:

at least one pressure detector placed upstream from the filter, at least one device for evaluating the volume flow rate of the gases on the filter, a device for controlling one or more throttles as a function of predetermined strategies linked with the running of the engine.

The device according to the invention can optionally comprise an array of partitions intended to isolate the various zones forming the filter means.

Furthermore, the partitions can be provided with openings so arranged that they allow propagation of the combustion from one zone to the other.

Furthermore, the control reacts as a function of the volume flow rate of the exhaust gases.

Additionally, the control reacts as a function of the pressure measured upstream from the filtering means.

More particularly, the device according to the invention comprises a temperature detector intended to evaluate the volume flow rate of the gases from the mass flow rate thereof.

The control advantageously allows determination of the aperture angle of each throttle means.

BRIEF DESCRIPTION OF THE DRAWINGS

Other features, advantages and details of the present invention will be clear from reading the description hereafter, given by way of non limitative example, with reference to the accompanying drawings wherein.

DESCRIPTION OF THE PREFERRED EMBODIMENTS

Figure 1:
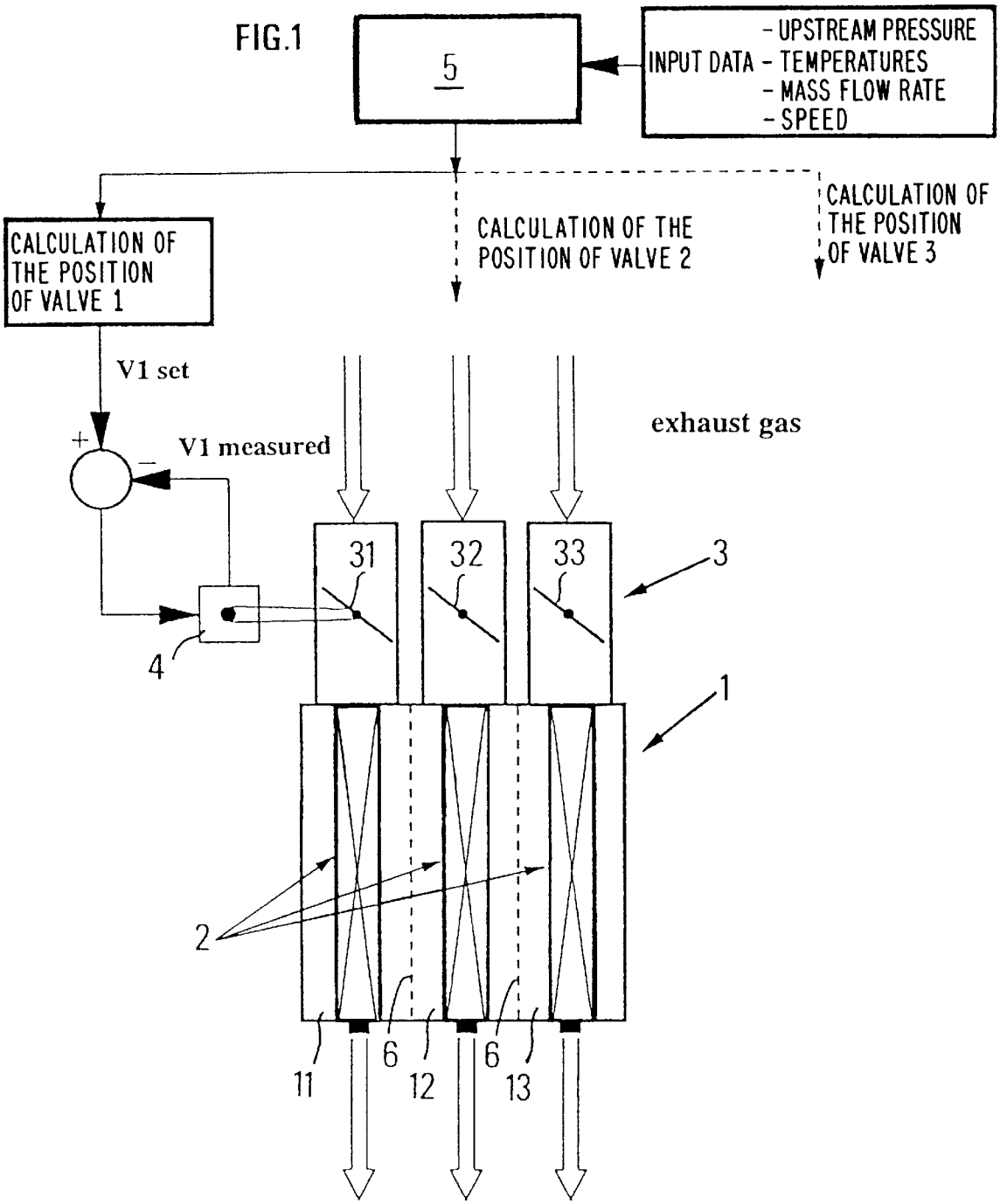
FIG. 1 is a flowchart of the device according to the invention.

FIG. 1 is a diagram illustrating the elements of the invention. These elements essentially comprise a particulate filter 1 divided in several zones 11, 12, 13. A filtering element, for example a filtering cartridge 12, is placed in each zone.

A throttling device 31, 32, 33 is associated with each zone. The throttling devices which are a plate as illustrated 31, 32, 33 are controlled by one or more actuators 4, independently of one another, according to predetermined strategies. To that end, a computer 5 controls each actuator by calculating the position of each throttling device as a function of various parameters and of various strategies.

Throttling devices 31, 32, 33 can be placed upstream or downstream from the filter with respect to the direction of flow of the exhaust gases. They never totally close the section of flow of filter 1.

An array of partitions 6 as illustrated in FIG. 1 can be used to isolate filtering zones 11, 12, 13 from one another. Such a device divides here particulate filter 1 in three equal angular sectors, a filtering element 2 being placed in each one of them. Besides, the partitions forming array 6 can be provided with openings so as to allow propagation of the combustion within filter 1 when combustion has started locally in one of filtering elements 2.

It is assumed here that filter 1 is divided in three substantially equal sectors having the characteristics mentioned above.

Of course, the number and the layout of partitions 6 can vary according to the type and to the size of the filter used.

Acquisition of the input data of computer 5 is performed by several detectors and notably by at least one pressure detector and at least one temperature detector placed upstream from the filter.

Furthermore, according to the present embodiment of the invention, two pressure detectors are placed on either side of filter 1; a device for evaluating the mass flow rate of the gases on the filter is also necessary.

Figure 2:
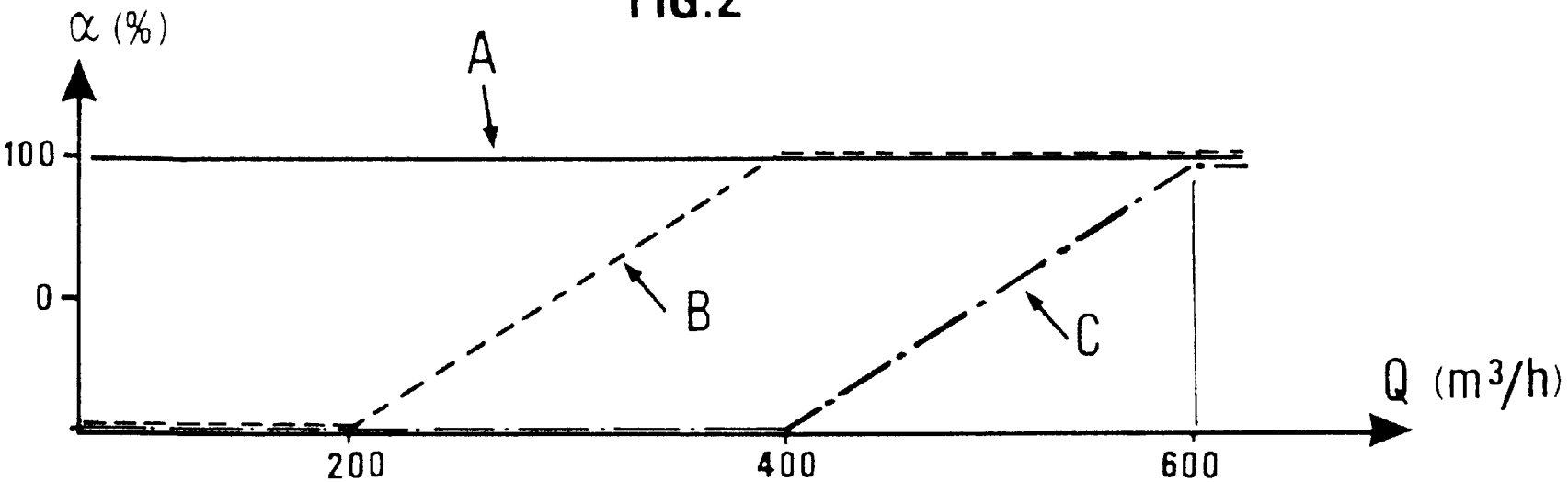
FIG. 2 shows curves illustrating control of the various valves as a function of the volume flow rate of the exhaust gases.

FIG. 2 illustrates one of the strategies for controlling the throttling devices associated with the filter. In the present case, throttling devices 31, 32, 33 are to be controlled according to the volume flow rate of the gases passing through filter 1, the volume flow rate being deduced both from the temperature upstream from the filter and from the mass flow rate.

By modulating the velocity of the gases in filter 1, an attempt is made to improve filtration (global efficiency, deep deposit), as well as the system acoustics.

The possibility of thus adapting the volume of the filter to the volume of the gas flowing therethrough allows the creation of optimum filtration conditions and a back pressure as limited as possible.

A possible opening/closing strategy of the various valves is illustrated by FIG. 2.

The ordinate of the curves of FIG. 2 gives (in %) the aperture angle a of each of the three valves associated with each of the angular sectors described above.

The abscissa of the curves shows the volume flow rate Q, in $m^3/h$, of the exhaust gases flowing through filter 1.

The behaviour of one of the three valves is illustrated by curve A in full line; the second valve is actuated according to curve B in dotted line while the third valve opens according to curve C in dot-and-dash line.

According to the strategy of FIG. 2, valve A is always opened whatever the flow rate; valve B opens progressively for mean volume flow rates (ranging between 200 and 400 $m^3/h$). Valve B remains opened for high flow rates. The third valve C only opens for high flow rates, i.e. above 500 $m^3/h$.

Thus, the total volume of filtration of the gases progressively adapts to the volume flow rate of the gases.

The volume flow rate Q can be evaluated from the mass flow rate and from a temperature measurement. The mass flow rate can be obtained by direct measurement, for example by means of a hot film flowmeter, or it can be deduced from an engine map. Besides, the hot film flowmeter can also be used for other specific needs of the engine control. The temperature of the gases is preferably measured upstream from the filter.

Figure 3:
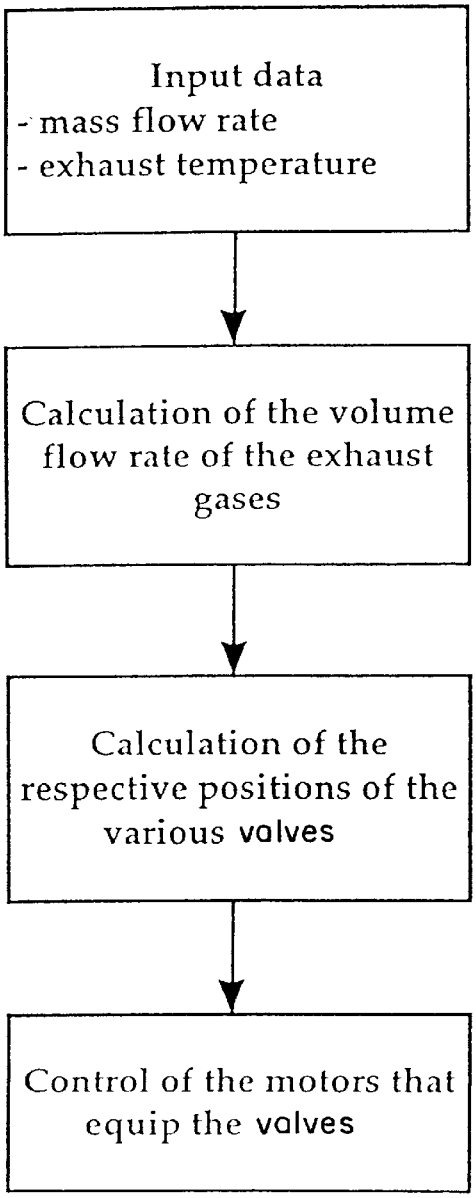
FIG. 3 is a simplified flowchart allowing implementation of one of the embodiments of the invention.

FIG. 3 is a simplified flowchart showing the main functions of computer 5. The input data are the mass flow rate (in kg/h) and the temperature of the exhaust gases. From these data, the computer determines the volume flow rate (in $m^3/h$) of the exhaust gases. According to pre-established strategies stored in the computer 5, the latter defines the respective positions of the various valves. It then triggers the controls of the various actuators associated with the valves so that the latter respond according to the curves of FIG. 2.

The strategy described in connection with FIGS. 2 and 3 can also create a fouling heterogeneity in the filter during prolonged low-load or part-load running of the engine. The study of spontaneous regeneration phenomena (particularly in the presence of additives) shows that the creation of such heterogeneities can facilitate local ignition conditions which depend on the concentration of trapped matter. Besides, stratification of the combustible matter favors good propagation of the combustion.

Furthermore, control of the fouling distribution within the filter can allow to obtain lower back pressures for a given total mass of particulates.

The valve opening strategy described above shows that, if running of the engine lasts at low load, cartridge A fouls up greatly whereas the other two cartridges B and C remain clean. Under such low speed and low torque conditions (heavy street traffic), fouling stratification favors the regeneration which is otherwise difficult to reach because of the low temperature of the exhaust gases. Even in case of transition to high loads (acceleration), the fouling heterogeneity thus created is translated into more favorable regeneration conditions. The present invention thus allows organizing fouling, to control it and consequently to organize regeneration of the filter.

Figure 4A:
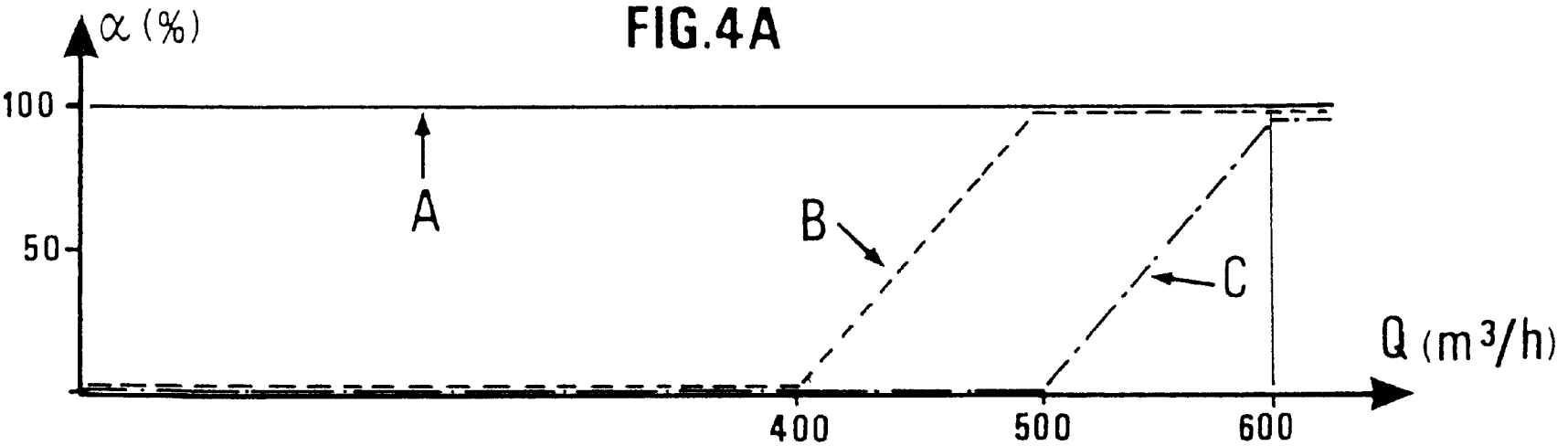
FIGS. 4A and 4B show curves illustrating control of the various valves as a function of the volume flow rate for various fouling levels of the filter.
Figure 4B:
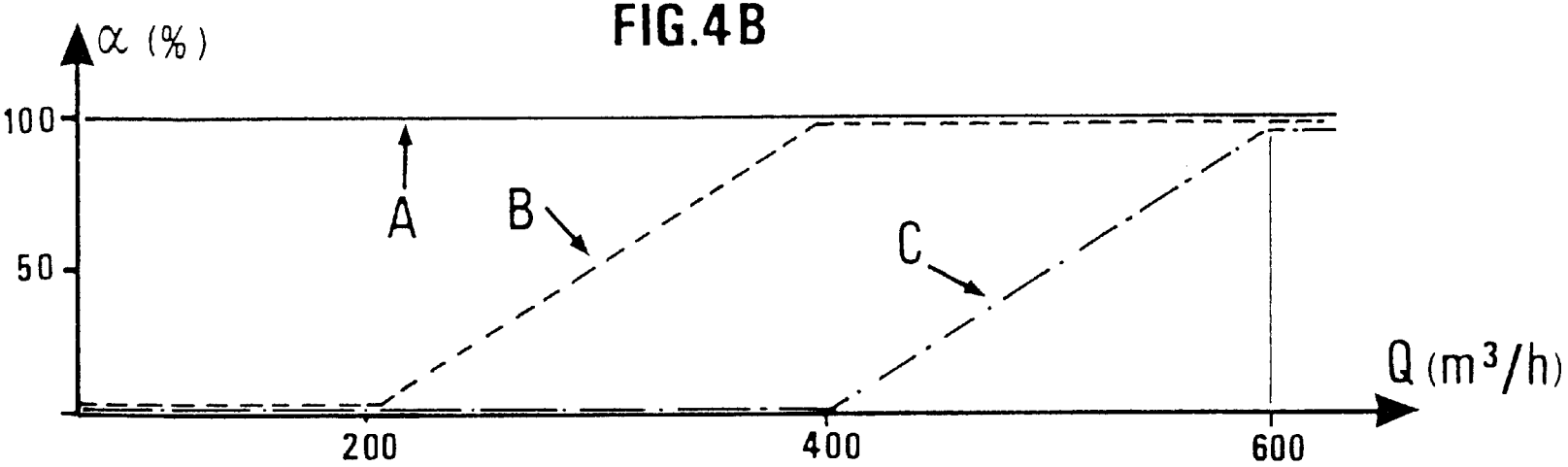

FIGS. 4A and 4B correspond to strategies that take account of the fouling level of the filter.

In this case, the opening thresholds of the various valves as a function of the volume flow rate of the gases also evolve as a function of the pressure measured upstream from the filter. When the fouling level is low (instance shown in FIG. 4), valves B and C open for high volume flow rates, for example above 400 $m^3/h$.

When fouling becomes extensive (FIG. 4B), it is useful to open valves B and C for lower gas volume flow rates in order to avoid too inconvenient a back pressure, i.e. for example as soon as the flow rate reaches 200 $m^3/h$.

Figure 5:
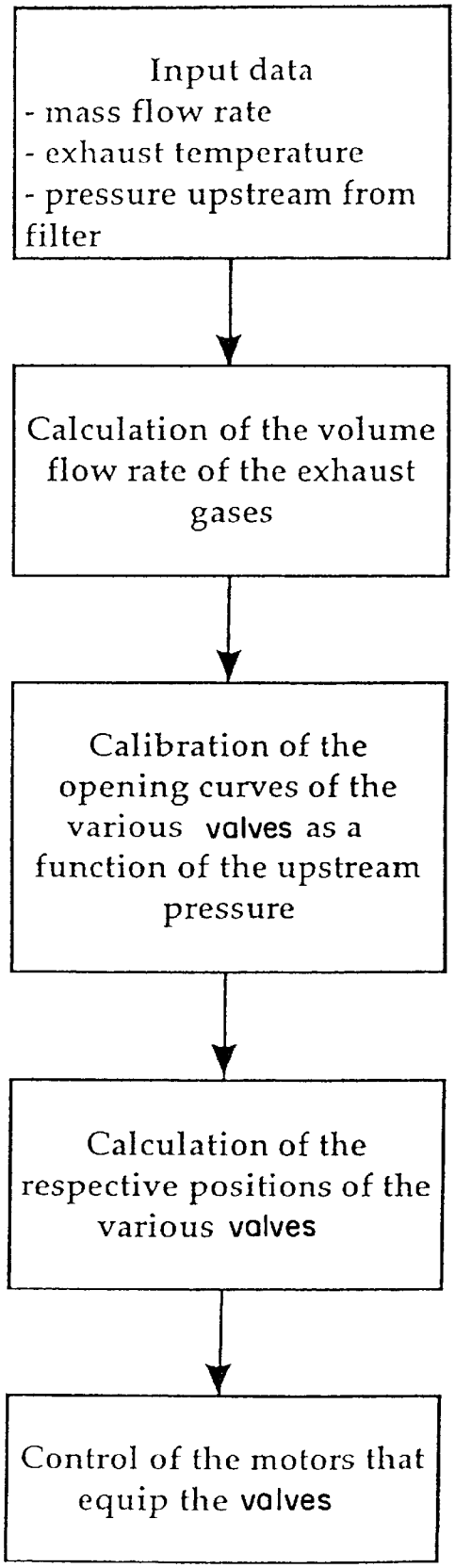
FIG. 5 is a simplified flowchart allowing implementation of the embodiment of the invention according to FIGS. 4A and 4B, FIGS. 6A, 6B, 6C are curves showing control of the various valves in order to create a heterogeneity according to the nature of the soots.

FIG. 5 shows a simplified flowchart of the working of computer 5. The input data are here the mass flow rate, the temperature and the pressure measured at least upstream from filter 1.

From these data, the computer determines the volume flow rate of the exhaust gases. Then, while taking account of the upstream pressure, the computer determines the fouling level and calculates the position of the various valve plates according to the curves of FIGS. 4A and 4B. The actuators associated with each of the plates are controlled thereafter.

It may be noticed that as long as fouling of the filter remains low (low back pressure), only one of the valves is open, the others remaining closed and opening only at the approach of high flow rates (FIG. 4A).

When the filter is fouled (FIG. 4B), only one valve is open at low flow rates (low speeds), but as soon as average speeds are reached, a second valve opens progressively, then the third valve opens in order to have a maximum opening for high flow rates (high loads).

In relation to the strategy mentioned in connection with FIG. 2, fouling represents the additional parameter taken into account here, which allows to reach the curves shown in FIGS. 4A and 4B.

Figure 6A:
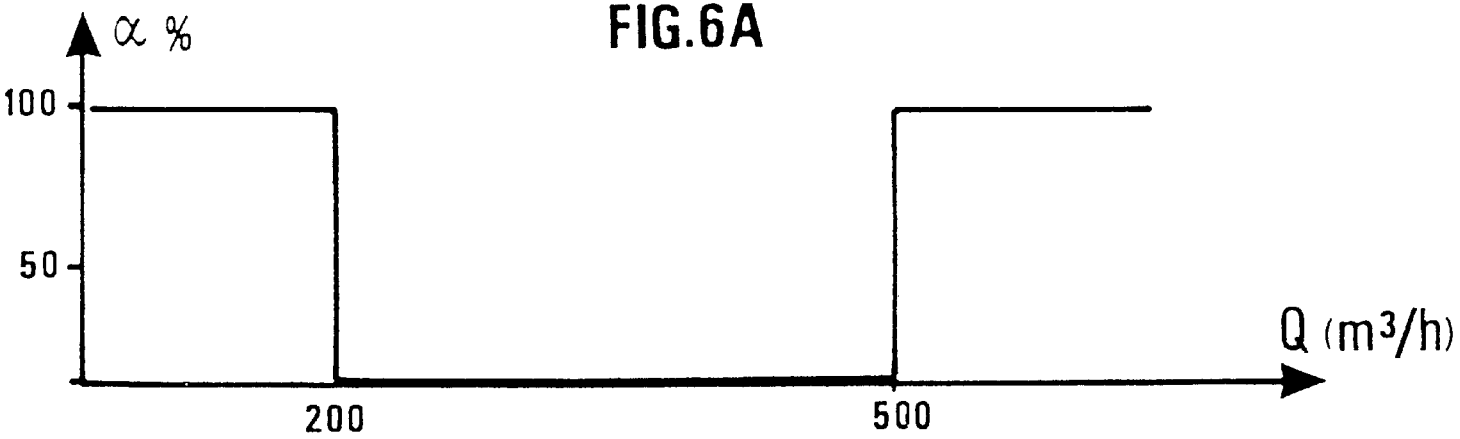
Figure 6B:
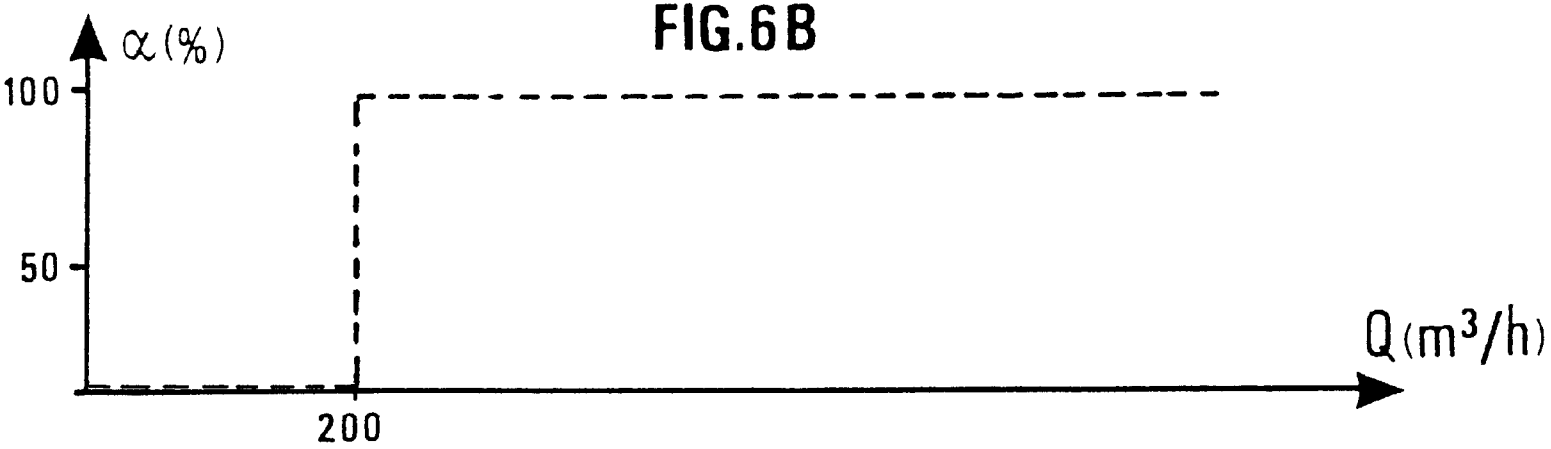
Figure 6C:
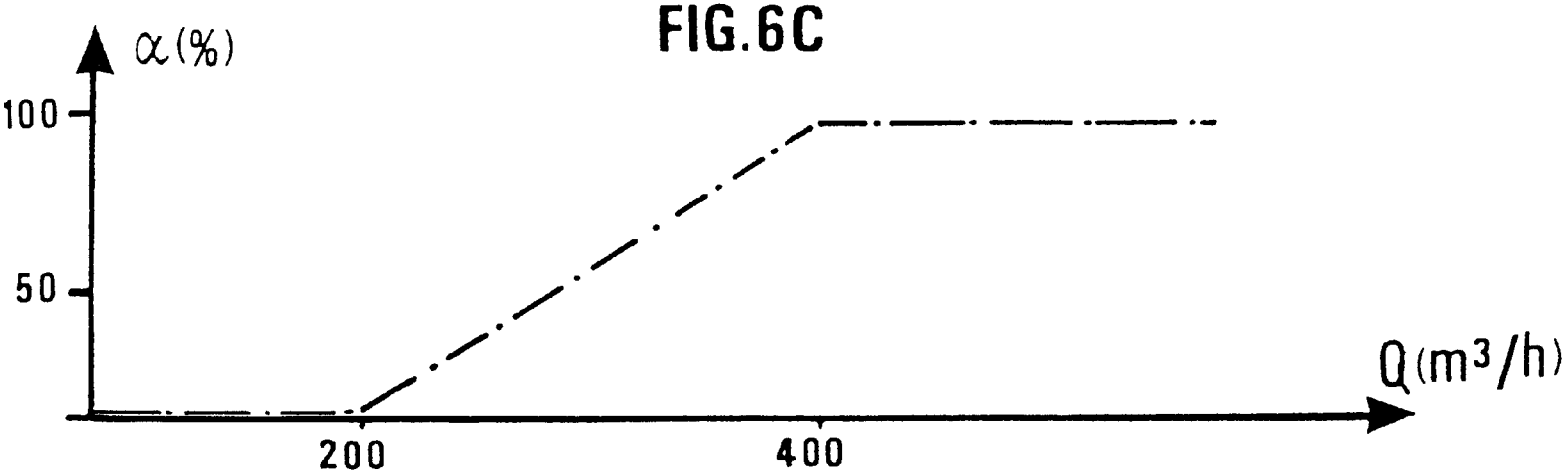

FIGS. 6A, 6B and 6C relate to another strategy of activation of the various plates associated with the various zones forming the filter.

In the present case, a zone of the filter is to be reserved for a hydrocarbon-rich soot deposit, the soot being generally produced at low loads and being (by nature) more easily burnt. This zone will exclusively foul up in the neighborhood of idle speed. Superposition of FIGS. 6A, 6B and 6C shows that for idle speed (low flow rates) only one valve is open, the others being closed. Thus, only the zone of filter 1 associated with the open valve preferentially fouls up in the neighborhood of idle speed.

At part load and speed, in order that the soot trapped at idle speed retains its properties favorable to combustion initiation, the zone in question is closed whereas the rest of the filter opens : valve 2 can open totally and instantaneously as shown in FIG. 6B, and the third valve can open progressively as shown in FIG. 6C.

For high speeds and loads (high volume flow rates), all the valves are open; this allows on the one hand limiting the exhaust back pressure and, on the other hand, to trigger regeneration in the cartridge fouled at low load, i.e. having a hydrocarbon-rich soot. Triggering of the combustion in this specific zone can also help initiate afterburning in the rest of the filter. This effect will be reinforced if the partitions of filter holder 6 have suitable openings.

This strategy thus allows creation deliberately of a heterogeneity in the filter as a function of the nature of the soots. In relation therewith, the filters adapts the geometry thereof to the driving scenario. It can be noted that a hydrocarbon-rich zone is created only during prolonged idle speed. In case of stabilized motorway driving, the filter works quite normally.

Another strategy for controlling regeneration of the particulate matter deposited on filter 1 can consist in performing temporary throttling of the whole filter. This leads to a heating of the exhaust gases, which itself allows to triggering of the regeneration.

More precisely, the strategy according to the invention monitors fouling of the filter by measuring the back pressure for example; then, when the latter reaches a certain threshold, in acting on one or the other of valves 31, 32, 33, simultaneously or separately, in order to limit the section of flow of the gases and to thus cause the temperature thereof to rise. Computer 5 allows to determination precisely of the aperture angle of each valve 31, 32, 33.

Interestingly, according to the invention, the strategy of throttling at a given time can be adapted to the fouling level and distribution resulting from the application of strategies described above, notably aimed at maintaining the fouling conditions of the filter. A direct advantage lies in that a lower back pressure is obtained at the exhaust, which contributes to increasing the engine performances. Besides, the present invention allows high-performance self-ignition.

I claim:

1. A process for controlling a particulate filter placed in an exhaust flow of an engine for performing an after-treatment of the particulates which requires a minimum amount of energy, comprising:

changing a geometry of the filter placed in the exhaust gas flow as a function of predetermined strategies linked with running of the engine; and changing a volume of the filter in which the exhaust gases are filtered as a function of a volume flow rate of gases that enter the filter, the changing of volume being produced by filter zones of the filter juxtaposed in cross section through which the exhaust gas can flow in parallel simultaneously through more than one filter zone in a plane perpendicular to the exhaust gas flow by interacting with at least one exhaust gas flow deflection device which deviates the exhaust gas flow in at least one of the filter zones, to limit a mean back pressure which degrades engine efficiency.

2. A process as claimed in claim 1, further comprising:

creating soot concentration heterogeneities in at least one zone of the filter.

3. A process as claimed in claim 1, further comprising:

reserving at least one zone of the filter for a particular soot type.

4. A process as claimed in claim 2, further comprising:

reserving at least one zone of the filter for a particular soot type.

5. A process as claimed in claim 1, wherein the filter comprises:

an array of partitions which isolate the zones.

6. A process as claimed in claim 2, wherein the filter comprises:

an array of partitions which isolate the zones.

7. A process as claimed in claim 3, wherein the filter comprises:

an array of partitions which isolate the zones.

8. A process as claimed in claim 4, wherein the filter comprises:

an array of partitions which isolate the zones.

9. A process as claimed in claim 5, wherein:

the partitions have openings allowing propagation of after-treatment combustion from one zone to another.

10. A process as claimed in claim 6, wherein:

the partitions have openings allowing propagation of after-treatment combustion from one zone to another.

11. A process as claimed in claim 7, wherein:

the partitions have openings allowing propagation of after-treatment combustion from one zone to another.

12. A process as claimed in claim 8, wherein:

the partitions have openings allowing propagation of after-treatment combustion from one zone to another.

13. A process as claimed in claim 1, further comprising:

limiting temporarily a section of flow of the exhaust gases in the filter when fouling exceeds a predetermined threshold value, so as to trigger regeneration by raising a temperature of the exhaust gases.

14. A process as claimed in claim 2, further comprising:

limiting temporarily a section of flow of the exhaust gases in the filter when fouling exceeds a predetermined threshold value, so as to trigger regeneration by raising a temperature of the exhaust gases.

15. A process as claimed in claim 3, further comprising:

limiting temporarily a section of flow of the exhaust gases in the filter when fouling exceeds a predetermined threshold value, so as to trigger regeneration by raising a temperature of the exhaust gases.

16. A process as claimed in claim 4, further comprising:

limiting temporarily a section of flow of the exhaust gases in the filter when fouling exceeds a predetermined threshold value, so as to trigger regeneration by raising a temperature of the exhaust gases.

17. A process as claimed in claim 5, further comprising:

limiting temporarily a section of flow of the exhaust gases in the filter when fouling exceeds a predetermined threshold value, so as to trigger regeneration by raising a temperature of the exhaust gases.

18. A process as claimed in claim 6, further comprising:

limiting temporarily a section of flow of the exhaust gases in the filter when fouling exceeds a predetermined threshold value, so as to trigger regeneration by raising a temperature of the exhaust gases.

19. A process as claimed in claim 7, further comprising:

limiting temporarily a section of flow of the exhaust gases in the filter when fouling exceeds a predetermined threshold value, so as to trigger regeneration by raising a temperature of the exhaust gases.

20. A process as claimed in claim 8, further comprising:

limiting temporarily a section of flow of the exhaust gases in the filter when fouling exceeds a predetermined threshold value, so as to trigger regeneration by raising a temperature of the exhaust gases.

21. A process as claimed in claim 9, further comprising:

limiting temporarily a section of flow of the exhaust gases in the filter when fouling exceeds a predetermined threshold value, so as to trigger regeneration by raising a temperature of the exhaust gases.

22. A process as claimed in claim 10, further comprising:

limiting temporarily a section of flow of the exhaust gases in the filter when fouling exceeds a predetermined threshold value, so as to trigger regeneration by raising a temperature of the exhaust gases.

23. A process as claimed in claim 11, further comprising:

limiting temporarily a section of flow of the exhaust gases in the filter when fouling exceeds a predetermined threshold value, so as to trigger regeneration by raising a temperature of the exhaust gases.

24. A device for controlling regeneration of particulates likely to be deposited on a filter placed in an exhaust gas flow of an engine, comprising:

at least two filtering zones dividing the filter, the zones being juxtaposed in cross section through which in parallel the exhaust gas can flow in a plane perpendicular to the exhaust gas flow;

at least one throttling device associated with at least one of the filtering zones which can modulate simultaneously a distribution of the exhaust gas flow through the at least two filtering zones;

at least one pressure detector placed in the exhaust gas flow upstream from the filter;

at least one device which evaluates a flow rate of the exhaust gases to the filter; and a control which controls the at least one throttling device as a function of predetermined strategies linked with running of the engine and a volume flow rate of the exhaust gases.

25. A device as claimed in claim 24, further comprising:

an array of partitions which isolate the zones forming the filter.

26. A device as claimed in claim 25, wherein:

the partitions have openings allowing propagation of combustion from one zone to another.

27. A device as claimed in claim 24, wherein:

the control also controls at least one throttling device as a function of pressure of the exhaust gas stream measured upstream from the filter.

28. A device as claimed in claim 25, wherein:

the control also controls at least one throttling device as a function of pressure of the exhaust gas stream measured upstream from the filter.

29. A device as claimed in claim 26, wherein:

the control also controls at least one throttling device as a function of pressure of the exhaust gas stream measured upstream from the filter.

30. A device as claimed in claim 24, further comprising:

a temperature detector used during determination of volume flow rate of the exhaust gases form a mass flow rate thereof.

31. A device as claimed in claim 25, further comprising:

a temperature detector used during determination of volume flow rate of the exhaust gases form a mass flow rate thereof.

32. A device as claimed in claim 26, further comprising:

a temperature detector used during determination of volume flow rate of the exhaust gases form a mass flow rate thereof.

33. A device as claimed in claim 27, further comprising:

a temperature detector used during determination of volume flow rate of the exhaust gases form a mass flow rate thereof.

34. A device as claimed in claim 24, wherein:

the control controls an aperture angle of each throttling device.

35. A device as claimed in claim 25, wherein:

the control controls an aperture angle of each throttling device.

36. A device as claimed in claim 26, wherein:

the control controls an aperture angle of each throttling device.

37. A device as claimed in claim 27, wherein:

the control controls an aperture angle of each throttling device.

38. A device as claimed in claim 28, wherein:

the control controls an aperture angle of each throttling device.

39. A device as claimed in claim 34, wherein:

a throttling device is associated with each of the zones.

40. A device as claimed in claim 35, wherein:

a throttling device is associated with each of the zones.

41. A device as claimed in claim 36, wherein:

a throttling device is associated with each of the zones.

42. A device as claimed in claim 37, wherein:

a throttling device is associated with each of the zones.

43. A device as claimed in claim 38, wherein:

a throttling device is associated with each of the zones.

* * * * *